United States Patent [19]

von Kwiatkowski et al.

[11] Patent Number: 4,774,107

[45] Date of Patent: Sep. 27, 1988

[54] PROCESS AND APPARATUS FOR APPLYING LIQUID, PASTY OR FOAMY SUBSTANCES TO BOTH SIDES OF WEBS OF MATERIAL

[75] Inventors: Kurt von Kwiatkowski, Bonn; Wolfram Dürr, Krefeld; Heinrich Mörtl; Rainer Schmidt, both of Solingen, all of Fed. Rep. of Germany

[73] Assignee: Vits Maschinebau GmbH, Langenfeld, Fed. Rep. of Germany

[21] Appl. No.: 26,802

[22] Filed: Mar. 17, 1987

[30] Foreign Application Priority Data

Apr. 2, 1986 [DE] Fed. Rep. of Germany ..... 3610943

[51] Int. Cl.[4] ..... B05D 1/28; B05D 5/00; B05C 1/00

[52] U.S. Cl. ..... 427/211; 118/216; 118/223; 118/224; 118/227; 427/428

[58] Field of Search ..... 118/216, 223, 224, 225, 118/226, 227; 427/211, 428

[56] References Cited

U.S. PATENT DOCUMENTS

| | | | |
|---|---|---|---|
| 2,199,228 | 4/1940 | Obenshain et al. | 91/50 |
| 2,383,964 | 9/1945 | Grupe | 117/7 |
| 3,843,389 | 10/1974 | Enomoto | 118/227 X |
| 4,384,544 | 5/1983 | Weishew | 118/227 X |

FOREIGN PATENT DOCUMENTS

| | | | |
|---|---|---|---|
| 2224732 | 12/1973 | Fed. Rep. of Germany . | |
| 2259250 | 6/1974 | Fed. Rep. of Germany | 118/227 |
| 2020199 | 11/1979 | United Kingdom . | |

*Primary Examiner*—Michael R. Lusignan
*Attorney, Agent, or Firm*—Sprung Horn Kramer & Woods

[57] ABSTRACT

The invention relates to a process and apparatus for applying liquid, pasty or foamy substances to both sides of webs of material. To prevent any adverse effect on the web of material or the applied substances, application is performed by means of a pair of S-rolls 7,11 at a looping angle just enough for the application, the web of material being guided substantially straight. The two applicator rolls 7,11 are disposed as close as possible to one another immmediately upstream of the drier inlet 1. At least one of the applicator rolls 11 can be moved out of the operating position, to enable the web of material to be drawn in unimpeded.

8 Claims, 2 Drawing Sheets

PROCESS AND APPARATUS FOR APPLYING LIQUID, PASTY OR FOAMY SUBSTANCES TO BOTH SIDES OF WEBS OF MATERIAL

BACKGROUND OF THE INVENTION

1. Field of the Invention

The invention relates to a process for applying liquid, pasty or foamy substances to both sides of webs of material, particularly swellable webs of material, by means of applicator rolls disposed one behind the other in the direction of movement of the web of material, followed by drying in a suspension drier.

2. Discussion of Prior Art

There is no problem in applying solvent-containing substances to webs of material, such as papers or nonwovens, since the solvent influences the behaviour of the web of material. In dependence of the kind of material, the web of material may stretch, shrink or fold as it runs over deflector or applicator rolls. It is true that in order to avoid folding, stretching rolls have been disposed downstream of the first applicator roll and/or the web of material has been levelled by intermediate drying. However, stretching rolls can be used to a limited extend, and may even be out of the question if the web has become sticky due to being impregnated with the substance to be applied, for example, a resin.

Another disadvantage of conventional processes is that the substances to be applied on both sides of the web have different periods of action available until drying, the result being loss of quality.

These disadvantages exist, for example, in a known apparatus for application on both sides, wherein the web of material is deflected around each of two deflector rolls and is therefore guided in S-shape. Between the first and second deflector rolls, an applicator roll applies the substance to one side of the web from below, the other substance being applied also from below to the other side of the web downstream of the second deflector roll. Due to the long path between the two places of application and the deflector roll the aforedescribed disadvantages may occur, more particularly with swellable and porous webs of material. Moreover, with such an arrangement of deflector and applicator rolls it is difficult to draw in the web of material.

Another difficulty arises in conventional processes if different kinds of substances are to be applied to the two sides of the web. In such cases there is a risk that the substances will become mixed with one another if the time elapsing until drying is too long.

Lastly, practical requirements demand that the substances shall be applicable not only uniformly, but precisely metered.

OBJECT OF THE INVENTION

It is an object of the invention to provide a process and apparatus for the uniform and metered application of liquid, pasty or foamy substances to both sides of webs of material, whereby the quality of the web is not adversely affected by the substances. The invention also enables the web of material to be readily drawn through the application mechanism into the suspension drier.

SUMMARY OF THE INVENTION

To this end, the process according to the invention is characterized in that the substance is applied on both sides in a layer thickness adjustable on the applicator rolls at places disposed immediately one after the other in space without the web of material being supported in the rear, the web being guided substantially straight and its angle of looping around the applicator rolls being adjustable, no action being taken on the web of material between the two coatings. More particularly, having regard to the speed of the web of material, the places of application are disposed at such a short distance after one another that the time during which the substance is applied at the first place of application is not long enough before the second place of application to impregnate the web of material and/or substantially reduce its strength.

The apparatus for the performance of the process, which comprises a suspension drier and applicator rolls disposed one after the other in the direction of movement of the web of material upstream of the drier inlet, is according to the invention characterized in that the applicators rolls take the form of a pair of S-rolls, a metering device being provided for each roll, and are disposed without contact pressure rolls as close as possible one after the other and with a looping angle which is just enough for the application of the substance and is so small that the web of material is guided substantially straight, at least one applicator roll being movable out of the application position so that the web of material can be drawn in unimpeded. The metering devices used can be adjustable wipers, squeezing rolls or the like.

The process steps according to the invention and the features of the apparatus ensure that after the first application and after the second application, until drying the web of material is not influenced by the substance applied to such an extend that the web stretches and/or shrinks and therefore becomes folded, and/or the substances to be applied on both sides become mixed. Due to the special arrangement of the applicator rolls, the period during which the substances act on the web is too short for its quality and shape to be negatively influenced in that way. The guiding of the webs of material over the two applicator rolls (S-rolls) and the metering of the substance at the rollers themselves ensure that on the one hand the substance is applied in a metered quantity to the two sides of the web, without the web being supported on the side opposite each applicator roll, while on the other hand the application period itself and the delay between the two coatings and until the start of drying is negligibly small. The adjustable small looping angle or at least one adjustable applicator roll not only enables the looping necessary for the application of a predetermined quantity of substance to be adjusted, but also enables the two applicator rolls to be moved far enough apart for the web ob material to be drawn in free of impedance.

Clearly, the applicator rolls can be designed in conventional manner—i.e., take the form of screened rolls or operate like immersion rolls, and wipers or squeezing rolls for metering the thickness of the layer on the rollers can be adjustable. The rolls can also be driven in the same direction as or in the direction opposite to the direction of movement of the web of material.

The process and apparatus according to the invention can be particularly advantageously used if the web of material is to be treated in two stages—i.e., if in the first stage a web of material, such as paper or a nonwoven is impregnated with a fill, such as urea, and after intermediate drying the substance is applied to both sides of the web of material thus pretreated, using the apparatus according to the invention.

In conventional two-stage processes, after being impregnated with the filler (urea) the web of material is only moderately dried by infrared radiation on both sides. In the second stage, the coating of a higher quality material is also performed by impregnation. For the metering of the quantity applied, the web of material then runs through the pair of squeezing rolls, from which the web moves into a suspension drier. A process of this kind fails to give a large throughput, nor does it permit precise metering of the outer applied layers of higher quality substance.

These disadvantages are obviated by one embodiment of the invention, wherein the web of material, more particularly paper of nonwoven, is filled more particularly by impregnation and subjected to intermediate drying before the substance is applied to the web on both sides. Preferably the intermediate drying is performed in a suspension drier. This construction of the apparatus is characterized in that an impregnating device with a drier is disposed upstream of the applicator rolls in the direction of movement of the web of material.

DESCRIPTION OF AN EMBODIMENT OF THE INVENTION

Figure 1:
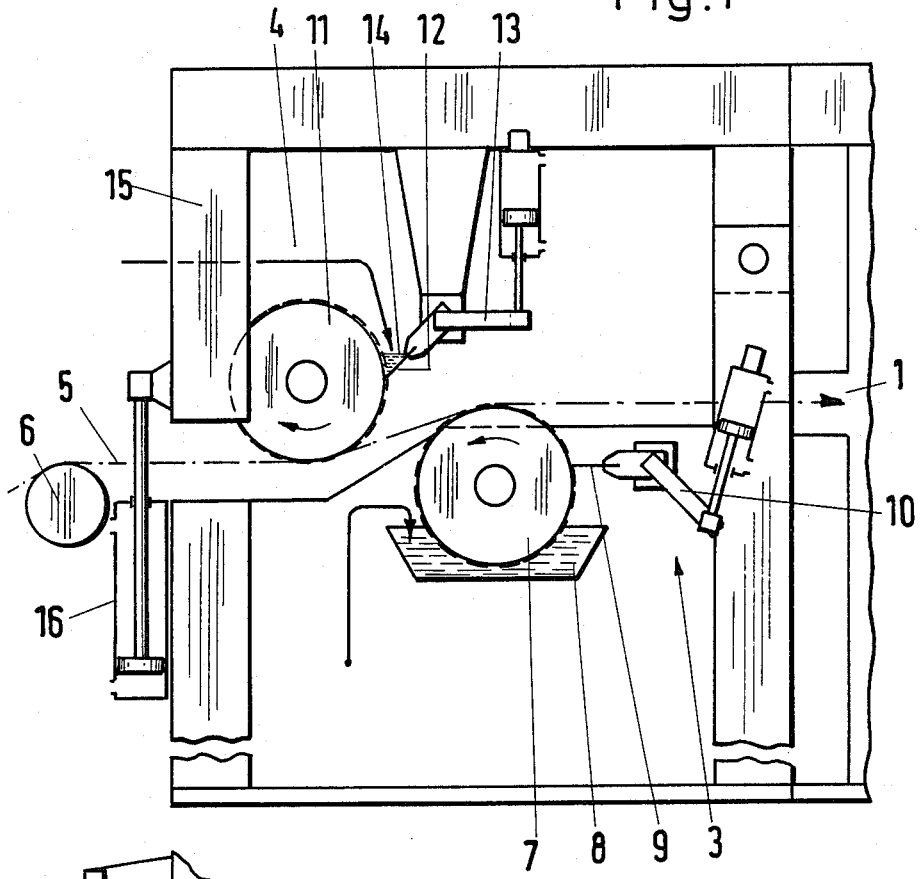
FIG. 1 shows a diagramatic side elevation of an apparatus for applying substances to both sides of webs of material.

Detailed Description of the Embodiment of the Invention

Disposed upstream of an inlet 1 (slot) of a suspension drier 2 are two applicator mechanisms 3,4 for applying liquid, pasty or foamy substances to a web of material 5 which is guided over a deflector roller 6.

The applicator mechanism 3 comprises an applicator roll 7, which takes the form of a screened roll and dips into the liquid substance in a bowl 8. A wiper can be adjusted via an adjusting member 10 in relation to the generated surface of the applicator roll 7. The applicator roll 7 is not vertically adjustable and is disposed with its apex in the guiding plane of the web of material 5 through the drier 2.

The second applicator mechanism 5 also comprises an applicator roll 11, in relation to whose screened generated surface 11 a wiper 12 can be adjusted via an adjusting member 13. Substance for application is supplied to a wedge 14 formed by the generated surface of the applicator roll 11 and the wiper 12. The roll 11, together with the wiper 12 and the adjusting member 13, is retained in a holder 15 which a lifting device 16 can move upwards out of the operating position shown in the drawing.

To draw in the web of material 5, the lifting device 16 moves the holder 15 upwards, thus producing a large enough unobstructed space through which the web of material 5 can be drawn in without impedance. After the web has been drawn in, the holder 15 is moved down again into the position illustrated in the drawing, in which the two applicator rolls 7,11, close to one another, form a pair of S-rolls. In this operating position the web of material 5 loops around the particular applicator roll only over a small area, which is substantially smaller than 90° looping angle. With this small looping angle, which means that the web of material 5 is still being guided substantially straight, on the one hand the substance can be satisfactorily applied without the web being supported on the rear side, and on the other hand the applicator rolls can be disposed immediately one beside the other, so that the delay between application to one side of the web and application to the other side is negligibly small having regard to the speed of the web, or at any rate so small that the solvent contained in the substances cannot have a negative influence on the web.

Figure 2:
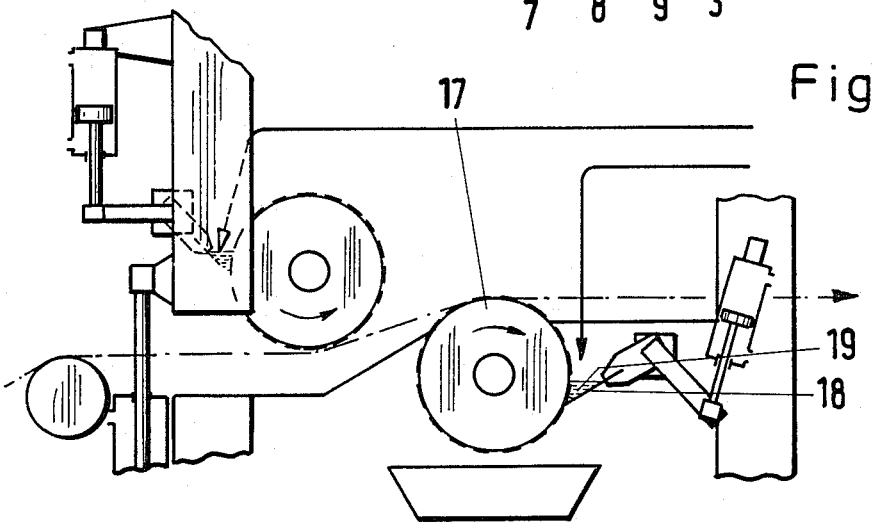
FIG. 2 shows a diagramatic side elevation of a detail of a variant embodiment of the apparatus shown in FIG. 1.

The embodiment illustrated in FIG. 2 essentially differs from that shown in FIG. 1 only by the feature that the first applicator roll 17 does not take the form of an immersion roll, but the substances to be applied are introduced into the wedge 19 formed by the generated surface of roll 18 and an adjustable wiper 19.

Clearly, the applicator rolls 7,11,17 can run contrary to (FIG. 1) or in the same direction as (FIG. 2) the web of material.

Clearly also instead of an applicator roll with a screened generated surface and adjustable wiper, an applicator roll can be provided having a smooth generated surface and a squeezing roll adjustable thereon, to meter the substance to be applied.

Figure 3:
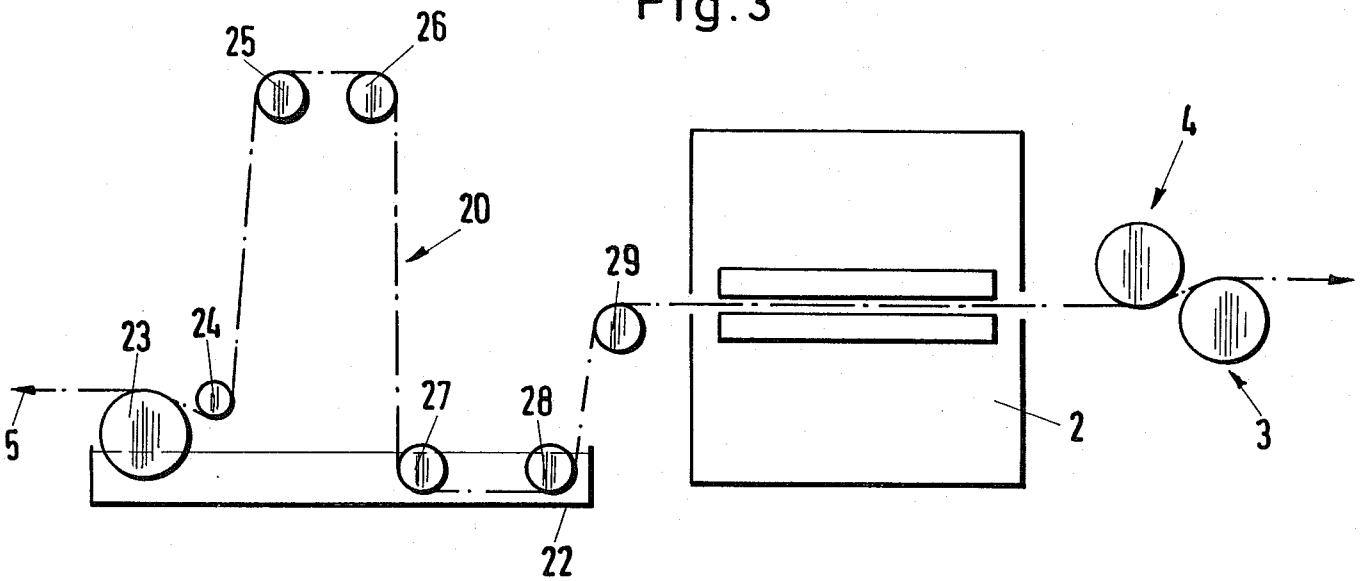
FIG. 3 shows a diagramatic side elevation of an apparatus as shown in FIG. 1 or FIG. 2 with a preceding impregnation apparatus and suspension drier.

The embodiment illustrated in FIG. 3 is extended by an impregnating device 20 and suspension drier 2 preceding the applicator mechanisms 3 and 4. The impregnating device comprises a tank filled with impregnating liquid, for example, a filler (urea), an applicator roll 23 which dips into the impregnating liquid and applies the filler to the web of material 5, deflector rolls 24,25 disposed above the impregnating liquid and deflector rolls 27,28 disposed in the impregnating liquid, which guide the web of material 5 therethrough. The web of material 5 filled with the impregnating liquid is deflected into the horizontal on a deflector roll 29. The deflector roll 29 can be an air-blast-fed roll or an air saddle over which the web of material is guided without contact. The suspension drier 2 can dry the web of material more efficiently than an infrared radiator. The web of material thus filled with filler then passes to the applicator mechanisms 3,4, which merely need to apply further small quantities of the higher quality substance to the filled web of material. Since the web of material has previously been filled with filler, the result is therefore a uniform, smooth coating.

What is claimed is:

1. A process for applying liquid, pasty or foamy substances on both sides of a web of material, comprising the steps of:

moving a web along a given direction;

disposing applicator rolls on both sides of the web with one immediately behind the other along the given direction and in contact with one surface thereof such that the web is supported on only one surface at each application roll and the web is guided substantially straight therethrough;

adjusting the layer thickness directly on the applicator rolls;

drying the web in a suspension drier only after both coatings; and wherein the applicator rolls are spaced apart at a predetermined distance for the speed of the web such that the time during which a substance is applied at a first roller and a substance is applied at the second roller is not sufficiently long to impregnate the web of material and substantially reduce the strength of the web of material.

2. A process according to claim 1, wherein no intermediate drying takes place between the two coatings.

3. A process according to claim 1, wherein the web of material is filled with a second substance and given an intermediate drying before a main substance is applied to the web on both sides.

4. A process according to claim 3, wherein the filling with a second substance is performed by impregnating the web of material.

5. The process according to claim 1, wherein the looping angle around the rolls to the web is less than 90°.

6. An apparatus for applying liquid, pasty or foamy substances on both sides of a web of material, comprising:

means for moving a web along a given direction;

applicator rolls on both sides of the web with one immediately behind the other along the given direction and in contact with one surface thereof such that the web is supported on only one surface at each application roll and the web is guided substantially straight therethrough;

means for adjusting the layer thickness directly on the applicator rolls;

means for drying the web downstream of the applicator rolls; and wherein the applicator rolls are spaced apart at a predetermined distance for the speed of the web such that the time during which a substance is applied at a first roller and a substance is applied at the second roller is not sufficiently long to impregnate the web of material and substantially reduce the strength of the web of material.

7. An apparatus according to claim 6, wherein the adjusting means comprises an adjustable wiper.

8. An apparatus according to claim 6, further comprising an impregnating device with a drier is disposed upstream of the applicator rolls in the direction of movement of the web of material.

* * * * *